US007550670B2

(12) United States Patent
Kuo

(10) Patent No.: US 7,550,670 B2
(45) Date of Patent: Jun. 23, 2009

(54) CABLE ASSEMBLY

(75) Inventor: Peter Kuo, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 21 days.

(21) Appl. No.: 11/825,862

(22) Filed: Jul. 9, 2007

(65) Prior Publication Data

US 2008/0009193 A1 Jan. 10, 2008

(30) Foreign Application Priority Data

Jul. 7, 2006 (CN) ..... 2006 1 0086342

(51) Int. Cl.
*H01R 4/00* (2006.01)

(52) U.S. Cl. ..... 174/74 R; 174/78

(58) Field of Classification Search ..... 174/74 R, 174/77 R, 79, 84 R, 92, 93; 333/12, 166, 333/175; 336/65, 92, 175
See application file for complete search history.

(56) References Cited

U.S. PATENT DOCUMENTS 4,972,167 A * 11/1990 Fujioka ..... 336/92
4,992,060 A * 2/1991 Meyer ..... 439/620.21
5,343,184 A * 8/1994 Matsui et al. ..... 336/92
5,355,109 A * 10/1994 Yamazaki ..... 336/92
5,764,125 A * 6/1998 May ..... 336/92
5,900,796 A * 5/1999 Parker ..... 336/92
5,920,250 A * 7/1999 Watanabe et al. ..... 336/92
5,942,964 A * 8/1999 Takeuchi ..... 336/92
6,072,125 A * 6/2000 Takeuchi ..... 174/92
6,512,425 B2 * 1/2003 Morita et al. ..... 333/12
6,633,000 B2 * 10/2003 Kuo ..... 174/92
7,052,283 B2 5/2006 Pixley

* cited by examiner

*Primary Examiner*—William H Mayo, III
(74) *Attorney, Agent, or Firm*—Wei Te Chung

(57) ABSTRACT

A cable assembly comprises a shell (1) comprising at least one post (127), a ferrite core (3) having two end face (33) and a main portion (32) and defining a perforation (31) and a cable (2) comprising a plurality of wires rounding the ferrite core by leading the cable to extend through the perforation at least once, and the cable forming at least one bending portion (21) adjacent to the one end face of the ferrite core, the post (127) of the shell disposing between the bending portion and the ferrite core.

15 Claims, 7 Drawing Sheets

CABLE ASSEMBLY

BACKGROUND OF THE INVENTION

1. Field of the Invention

The present invention relates to a cable assembly, and particularly to a cable assembly having a ferrite core.

2. Description of Prior Arts

Usually, the signals between two electronic systems are transmitted by a cable, and the cable includes a plurality of wires. As two electronic systems need to transmit more and more signals, the number of the wires becomes more and more. Accordingly, the cable has to add a mechanism to resist the influence to the signals from transient electric current. A ferrite core is put on the cable to filtrate wave to resolve the above mentioned problem. The ferrite core defines a hole for the cable to extend through, and would perform more efficiently if the cable loops around the ferrite core more than one turn. The cable forms at least one bending portion adjacent to the end face of the ferrite core. Accordingly, the relative positions of the wires of the cable at the bending portion are changed. The change of the positions of the wires of the cable makes the impedance of the bending portion of the cable change. And the signals transmitted by the cable is changed suddenly because of the different impedance between the bending portion and the other portion of the cable.

Obviously, a new cable assembly is needed to resolve above mentioned problem.

SUMMARY OF THE INVENTION

An object of the present invention is to provide a cable assembly with a filter that can prevent the signals from changing suddenly.

To achieve the above object, a cable assembly comprising a shell comprising at least one post, a ferrite core having a main portion, two end faces, and a perforation; and a cable comprising a plurality of wires, the cable extending through the perforation at least once to form at least one bending portion adjacent to one end face of the ferrite core; the post of the shell disposed between the bending portion and the ferrite core.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
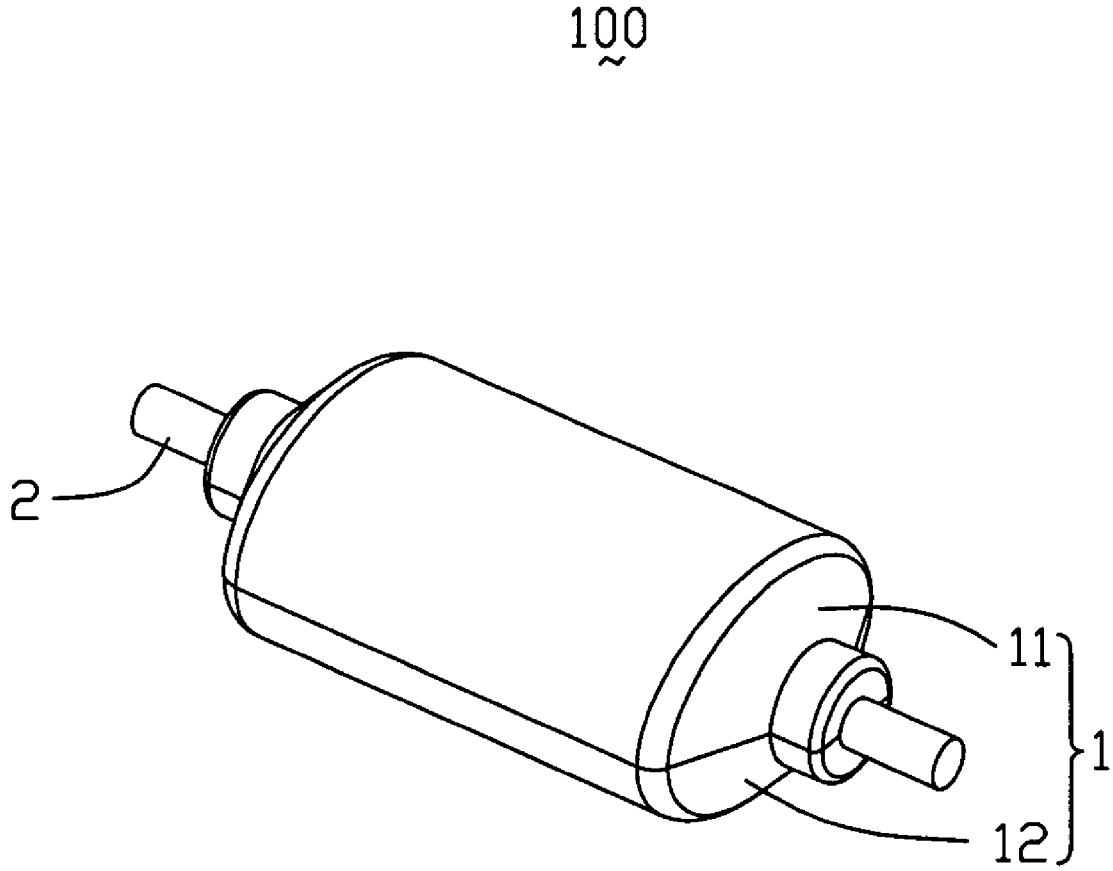
FIG. 1 is an assembled, perspective view of a cable assembly in accordance with the present invention.
Figure 2:
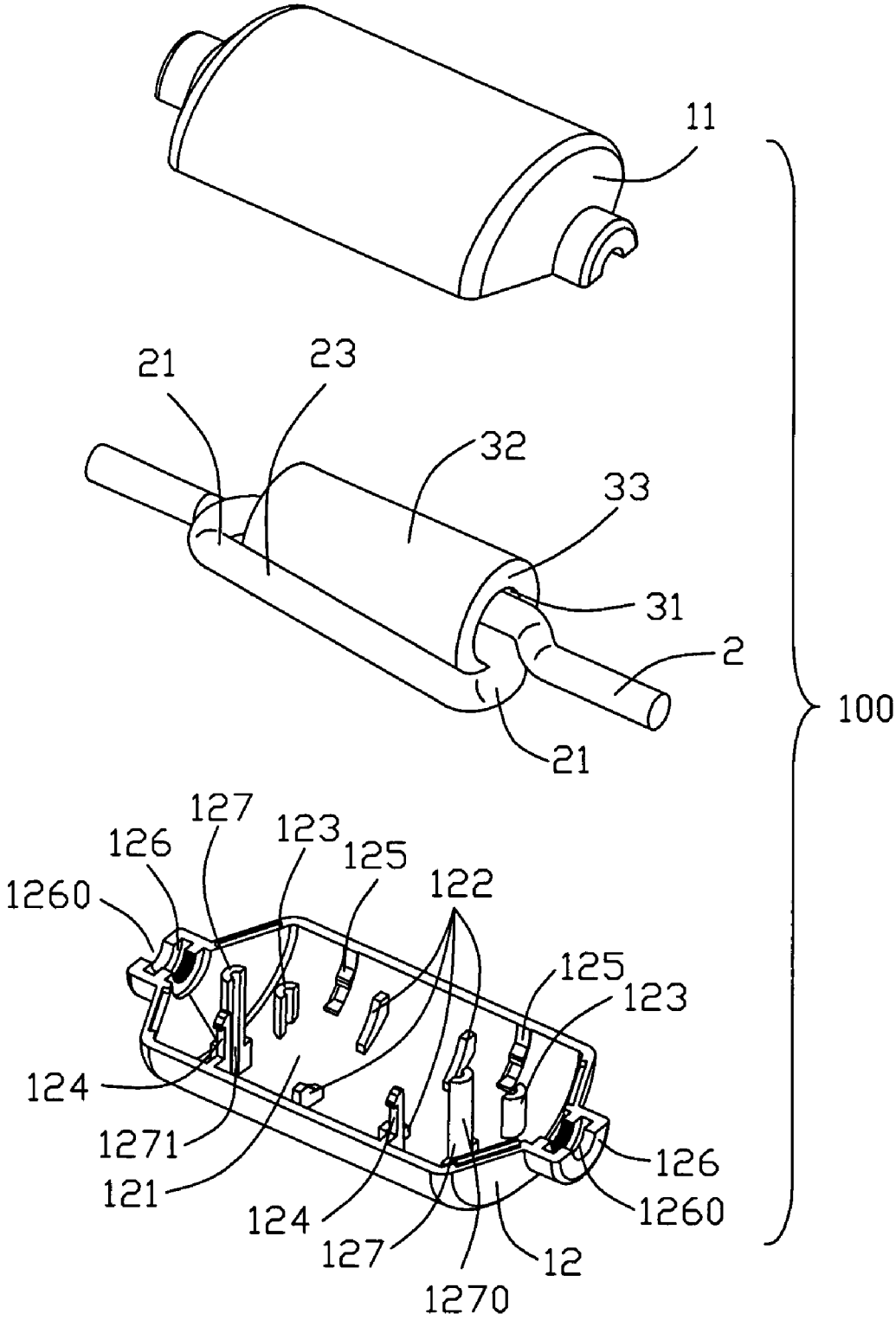
FIG. 2 is an exploded view of the cable assembly shown in FIG. 1.
Figure 3:
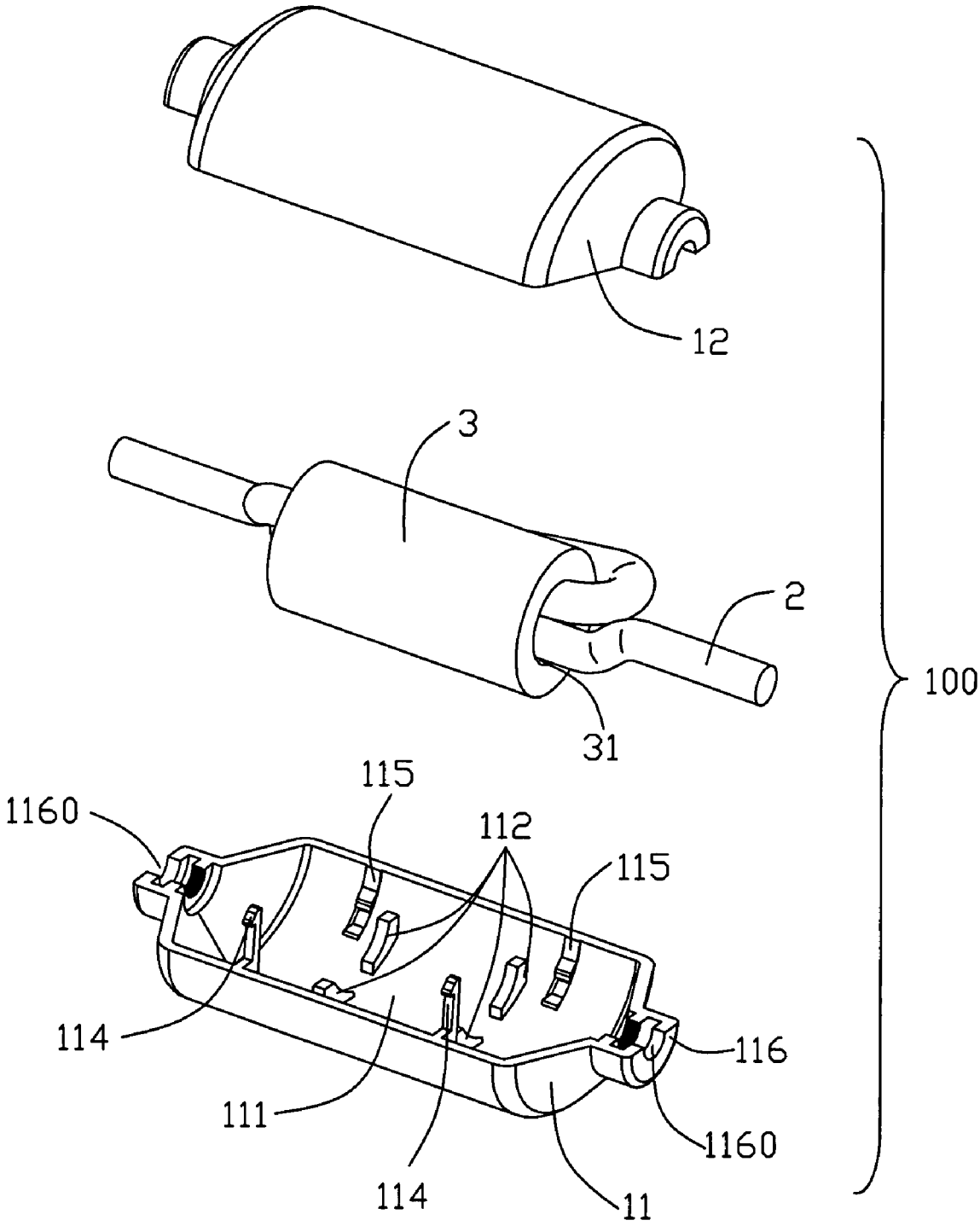
FIG. 3 is a view similar to FIG. 2, but taken from a different aspect.

Referring to FIGS. 1-3, the present invention relates to a cable assembly 100 with a filter. The cable assembly 100 includes a shell 1, a cable 2 and a ferrite core 3.

As shown in FIGS. 2 and 3, the shell 1 has an elliptical or oval cross-section, and comprises a top shell 11 and a bottom shell 12. Both the top shell 11 and the bottom shell 12 are configured of semi-ellipse column. The bottom shell 12 forms a first inside wall 121. There are two pairs of first rib boards 122 formed on the first inside wall 121, and each pair of the first rib boards 122 are located face to face with each other. There are two blocks 123 and two posts 127 extending upwardly from the first inside wall 121 of the bottom shell 12. The two blocks 123 and the two posts 127 are, respectively, face to face with each other. The two posts 127 are configured of semi-column, and comprises a semicircle cambered surface 1270 and a planar surface 1271. The planar surfaces 1271 of the posts are face to face. There are a pair of first retaining portions 126 formed on the opposite sides of the bottom shell 12 in a longitudinal direction, and each first retaining portion 126 defines a first receiving passage 1260. A pair of first locking arms 124 and a pair of first locking portions 125 are formed on the first inside wall 121 of the bottom shell 12 in a front-to-back direction, perpendicular to the said longitudinal direction. The top shell 11 comprises a second inside wall 111, and two pairs of second rib boards 112 formed on the second inside wall correspond to the first rib boards 122 of the bottom shell 12. There are a pair of second locking arms 114 and a pair of second locking portions 115 disposed on the second inside wall 111. The first locking arms 124 lock with corresponding second locking portions 115 and the first locking portions 125 lock with corresponding second locking arms 114. Thereby the top shell 11 is assembled to the bottom shell 12. The top shell 11 has a pair of second retaining portions 116 on the opposite sides in the longitudinal direction. Each second retaining portion 116 defines a second receiving passage 1160.

The cable 2 has a plurality of wires (not shown) for transmitting the signals between two electrical systems. And the cable 2 can be bended.

The ferrite core 3 is configured of column, and can eliminate the wave from the cable 2. The ferrite core 3 comprises a main portion 32, and a perforation in the longitudinal direction, and forms two end faces 33, each end face 33 is configured of ring.

Figure 4:
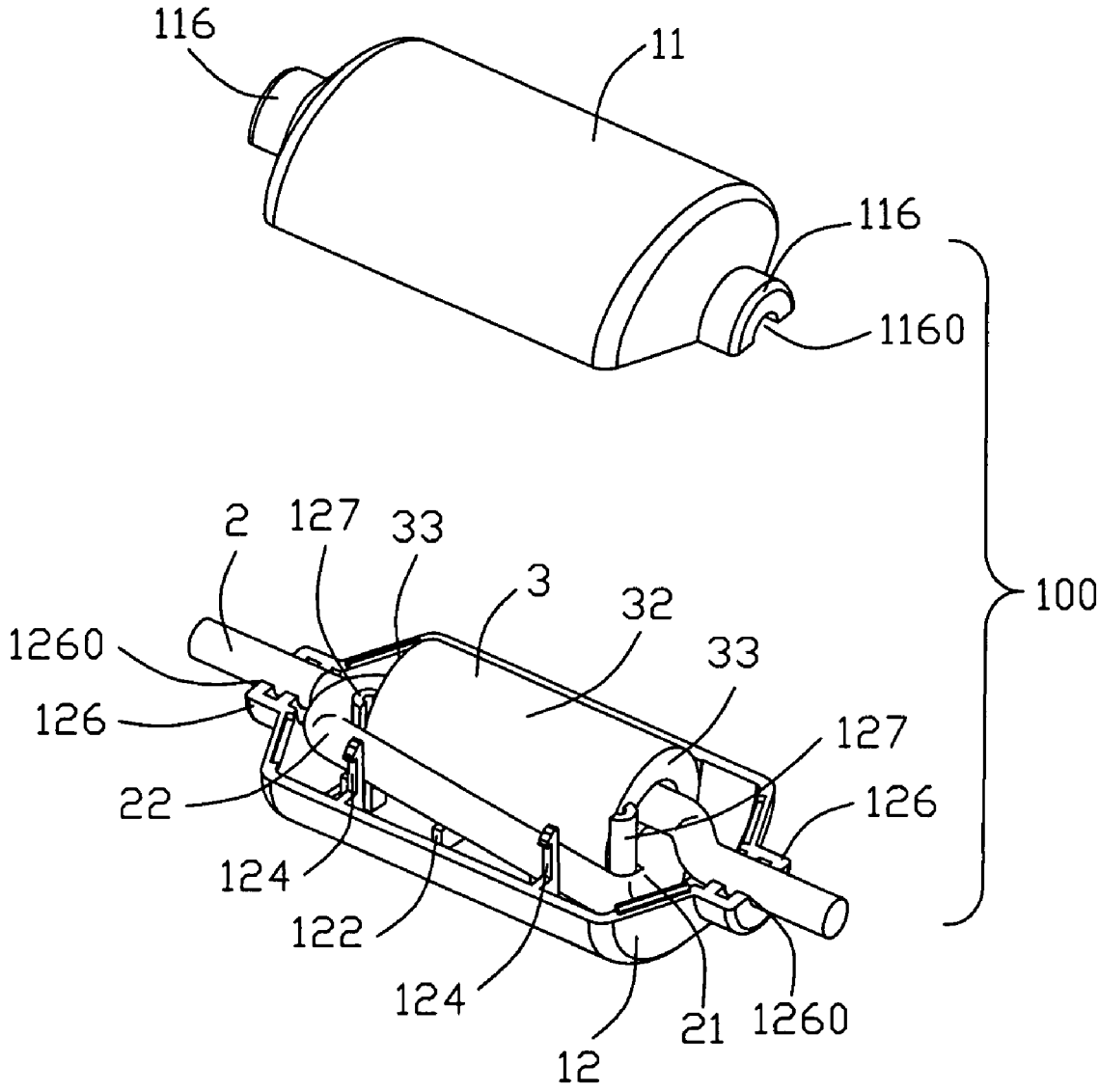
FIG. 4 is another exploded view of the cable assembly shown in FIG. 1.

As shown in FIG. 4, the cable 2 loops around the main portion 31 of the ferrite core 3 by extending through the perforation 31 twice. And the cable 2 forms two bending portions 21 adjacent to the two end faces 33 of the ferrite core 3. The ferrite core 3 can eliminate wave from the cable 2 by leading the cable 2 to extend through the perforation 31 and the ferrite core 3 can achieve a better effect by leading the cable 2 to extend through the perforation 31 twice or more. The ferrite core 3 with the cable 2 is assembled to the bottom shell 12, the main portion 32 of the ferrite core 3 engages with the first rib boards 122 of the bottom shell 12. Each first rib board 122 forms cambered surfaces to meet the outside surface of the main portion 32. The two end faces 33 of the ferrite core 3 are sandwiched by the pair of blocks 123. The post 127 is located between the bending portions 21 of the cable 2 and the end faces 33 of the ferrite core 3. And each end face 33 of the ferrite core 3 bears against each planar surface 1271 of the post 127 respectively. The bending portions 21 of the cable 2 surround the semicircle cambered surfaces 1270 of the posts 127. The thickness of the end faces 33 have the same dimension with the width of the planar surfaces 1271. The cable 2 extending outside the perforation 31 can loop around the semicircle cambered surfaces 1270 of the posts 127 smoothly, and the bending portions 21 of the cable 2 can release stress concentration to retain the positions of the wires of the cable 2. And the cable 2 has the same impedance at either the bending portion 21 or the other portion of the cable, the signals transmitting by the cable 2 can avoid changing suddenly. At last, the top shell 11 mates with the bottom shell 12, and the second rib boards 112 of the top shell 11 press on the main portion 32 of the ferrite core 3. Now the ferrite core 3 is fixed between the top shell 11 and the bottom shell 12 stably. The pair of first locking arms 124 lock with corresponding second locking portions 115 and the first locking portions 125 lock with corresponding second locking arms 114 to secure the bottom shell 11 and the top shell 12 together. The cable 2 extends out of both opposite sides (not labeled) of the shell 1, and through the first receiving passages 1260 and the second receiving passages 1160. After assembled, the cable assembly 100 can prevent the signals transmitting by the cable 2 from being influenced by changing suddenly.

Figure 5:
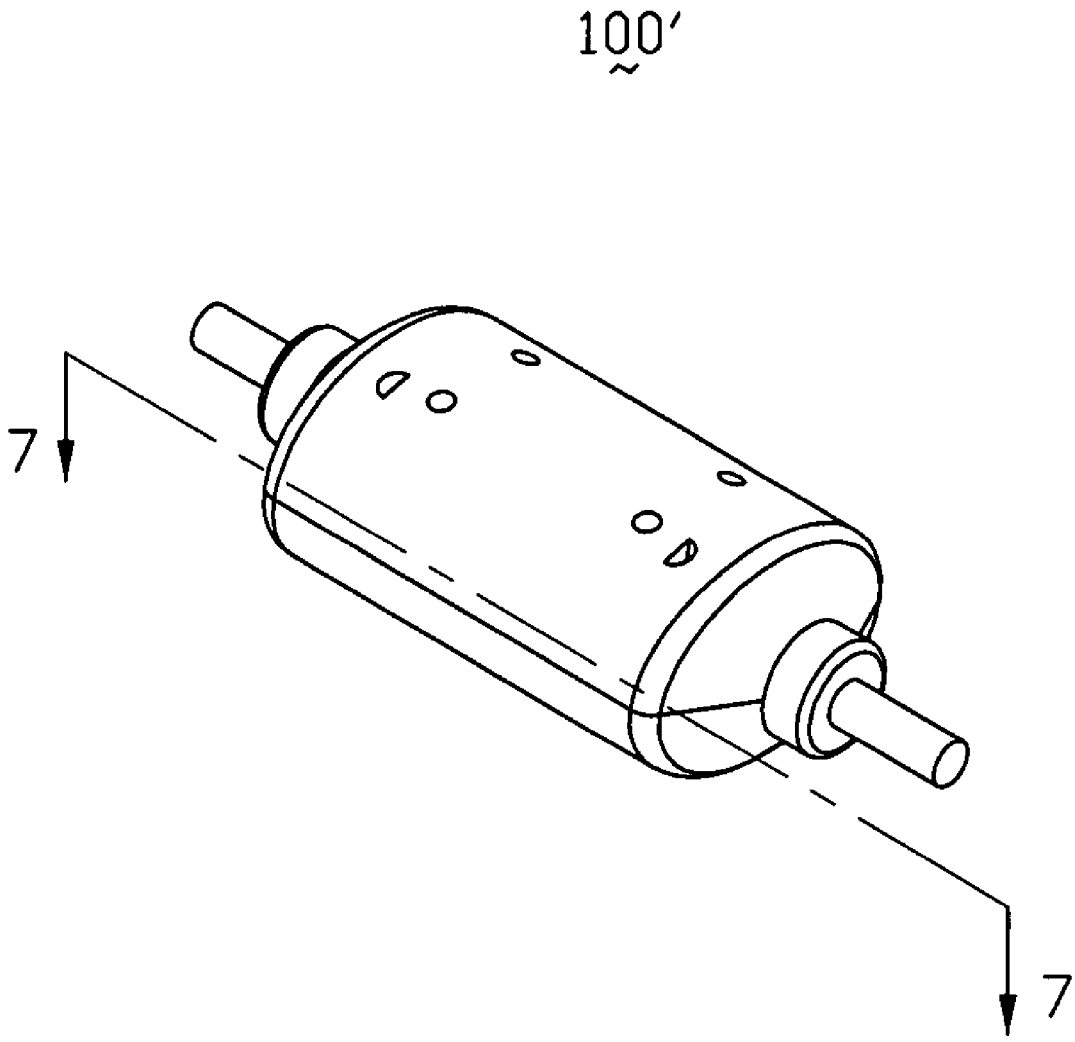
FIG. 5 is an assembled, perspective view of a second embodiment of the cable assembly.
Figure 6:
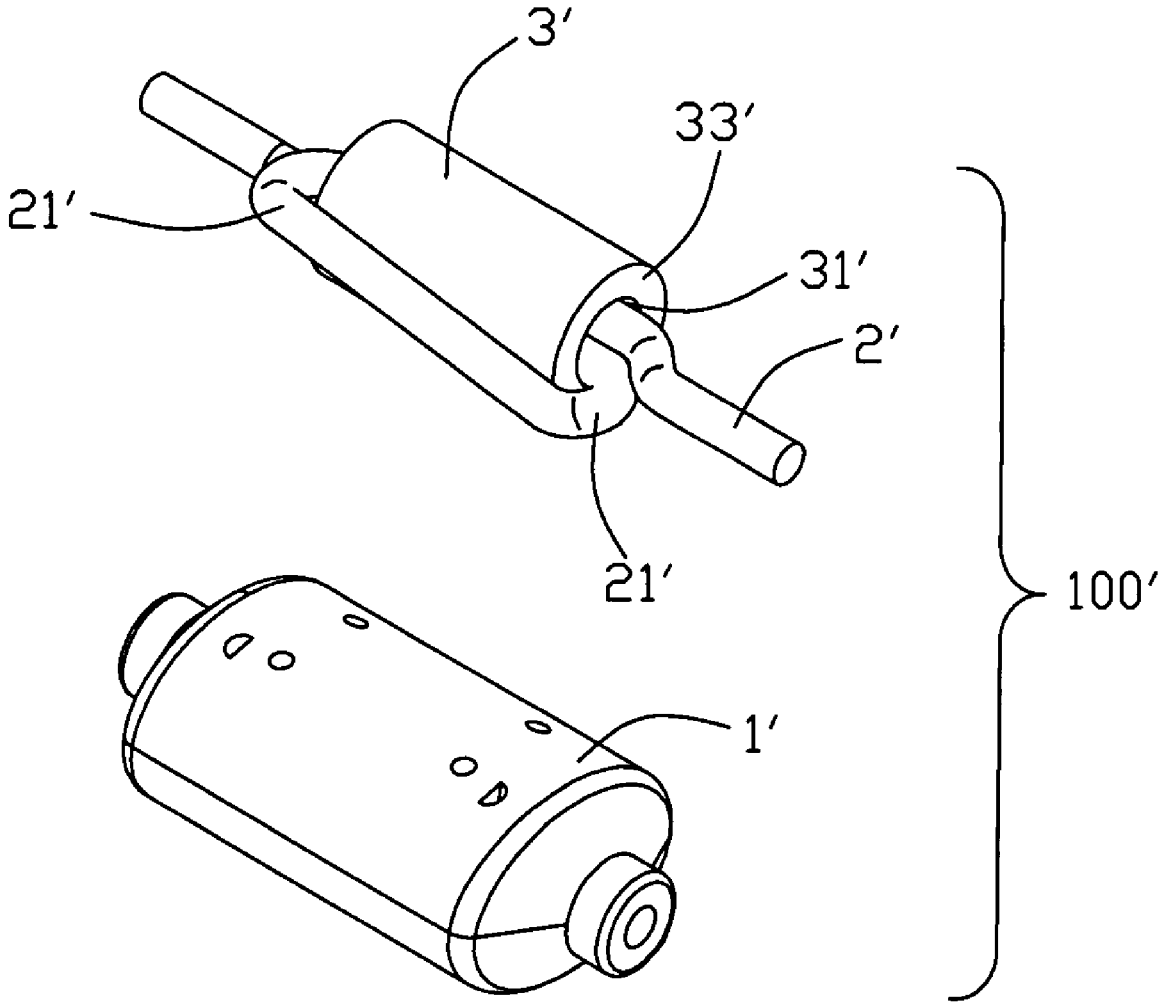
FIG. 6 is an exploded view of the cable assembly shown in FIG. 5.
Figure 7:
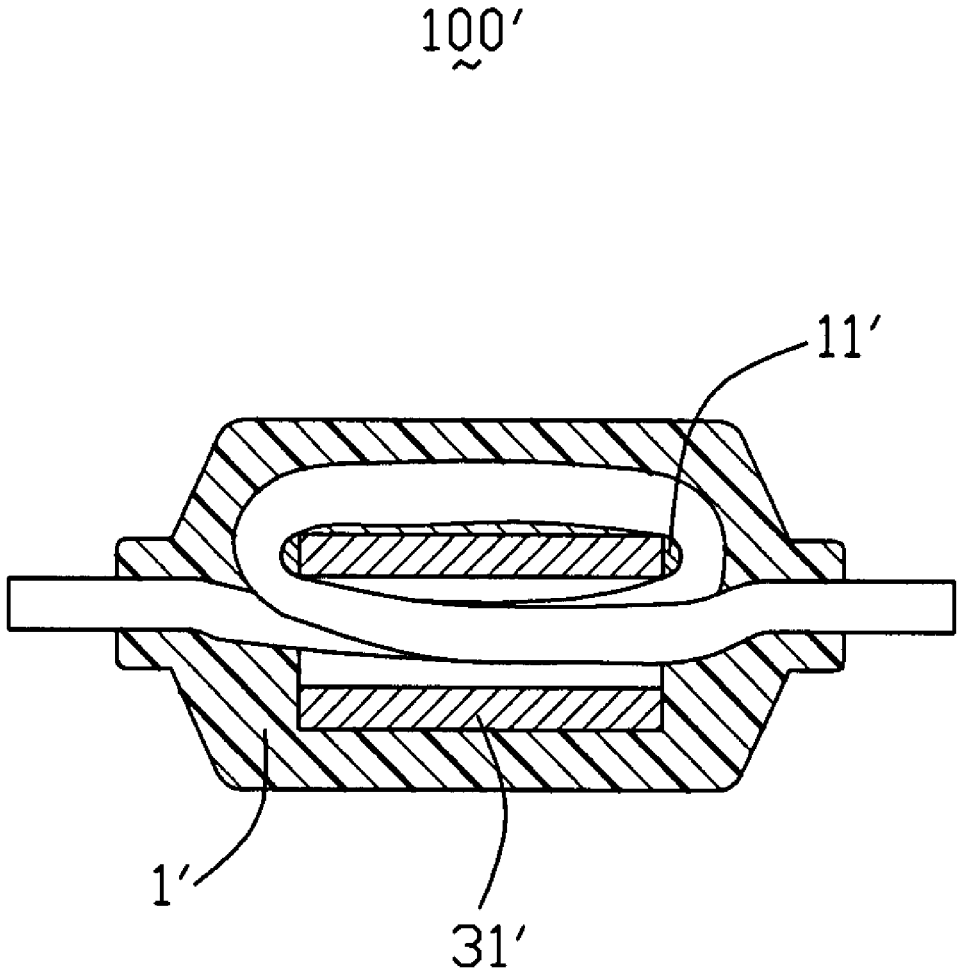
FIG. 7 is a cross-sectional view of FIG. 5 taken along line 7-7.

Referring to FIG. 5 to FIG. 7, the second embodiment of the cable assembly 100' comprises a shell 1', a cable 2' and a ferrite core 3'. The difference between the first embodiment and the second embodiment is that the shell 1' is over-molded on the cable 2', and is not separated into a top shell and a bottom shell.

In this embodiment, the cable 2' also loops around the main portion of the ferrite core 3' by extending through the perforation 31' twice. And the cable 2' has two bending portions 21'. The shell 1' is over-molded on the ferrite core 3' with the cable 2', and there is also a semi-column post 11' disposed between the bending portion 21' and the end face 33' of the ferrite core 3'. The pair of posts 11' act the same function as the pair of posts 127 referred to in the first embodiment.

So the cable assembly 100' also can prevent the signals transmitting by the cable 2' from influencing and changing suddenly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

a shell comprising at least one post;

a ferrite core having a main portion, two end faces, and a perforation; and a cable comprising a plurality of wires, the cable extending through the perforation at least once to grasp the ferrite core;

the post of the shell disposed adjacent to one of the two end faces of the ferrite core;

wherein the post has a semi-column surface and a planar surface, the planar surface engages with one of the two end faces, the cable extends around the semi-column surface forming a bending portion, and the bending portion of the cable engages with semi-column surface of the post.

2. The cable assembly as described in claim 1, wherein the shell comprises a top shell and a bottom shell being capable of separated from the top shell, and the post is formed on the bottom shell.

3. The cable assembly as described in claim 2, wherein the top shell forms locking portions and locking arms, and the bottom shell forms corresponding locking portions and locking arms locked with the locking arms and locking portions of the top shell, respectively.

4. The cable assembly as described in claim 2, wherein the ferrite core is received between the top shell and the bottom shell, and there are a plurality of rib boards on the top shell and the bottom shell, respectively, to retain the ferrite core in the shell, and the bottom shell defines a pair of blocks to sandwich the two end faces of the ferrite core.

5. The cable assembly as described in claim 2, wherein the cable extends though perforation twice, and the cable forms two bending portions adjacent to the two end faces, respectively, between the end face and the bending portion there being one post.

6. The cable assembly as described in claim 1, wherein the two end faces of the ferrite core are annular, and a radial thickness of the end face is substantially same as the width of the planar surface, the planar surfaces of the posts meet the end faces of the ferrite core, and the cable extends outside the perforation loop around the semi-column surface of the post.

7. The cable assembly as described in claim 1, wherein the shell is over molded on the ferrite core with the cable.

8. The cable assembly as described in claim 7, wherein the post is integrally formed with the shell and includes a semi-column cambered surface.

9. The cable assembly as described in claim 8, wherein the bending portion of the cable surrounds the semi-column cambered surface.

10. A cable assembly comprising:

a ferrite core received in a shell and defining a through hole between two opposite end faces thereof; and a cable extending through said through hole with at least one loop grasping said ferrite core; wherein at least one separator is configured of semi-column defining a semi-column surface and a planar surface located between the cable and at least one of the corresponding two end faces in an axial direction of said ferrite core for preventing said cable and at least one of the corresponding two end faces from directly contacting/wearing in said axial direction, the planar surface engages with one of the two end faces, and the cable extends round the semi-column surface.

11. The cable assembly as claimed in claim 10, wherein said separator is formed on the shell.

12. A cable assembly comprising:

a ferrite core received in a shell and defining a through hole between two opposite end faces thereof so as to be in a form of tube with a tubular thickness thereof; and a cable extending through said through hole with at least one loop grasping said ferrite core; wherein at least one separator located between the cable and at least one of the corresponding two end faces in an axial direction of said ferrite core for preventing said cable and at least one of the corresponding two end faces from directly contacting/wearing in said axial direction; wherein said separator defines thereof a semi-column surface facing outwardly in said axial direction to compliantly confront a bent/folded curved portion of said loop in said axial direction.

13. The cable assembly as claimed in claim 12, wherein said separator is formed on the shell.

14. The cable assembly as claimed in claim 12, wherein the separator defines a diameter dimensioned similar to said tubular thickness of the ferrite core.

15. The cable connector assembly as claimed in claim 12, wherein said separator is essentially aligned with a portion of a tubular wall of said ferrite core in said axial direction.

* * * * *